US006386922B1

(12) United States Patent
Forte et al.

(10) Patent No.: US 6,386,922 B1
(45) Date of Patent: May 14, 2002

(54) LOW PROFILE CONNECTOR WITH EXTENDING LATCH MECHANISM

(75) Inventors: Steven Lo Forte, Copperton; David Oliphant, West Valley City; Ryan Kunz, Roy, all of UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/687,129

(22) Filed: Oct. 13, 2000

(51) Int. Cl.[7] ..... H01R 17/18
(52) U.S. Cl. ..... 439/676; 439/131
(58) Field of Search ..... 439/131, 372, 439/676, 55

(56) References Cited

U.S. PATENT DOCUMENTS

| | | | | |
|---|---|---|---|---|
| 2,916,720 | A | 12/1959 | Steans | 339/91 |
| 4,186,988 | A | 2/1980 | Kobler | 339/176 MP |
| 4,241,974 | A | 12/1980 | Hardesty | 339/154 A |
| 4,303,296 | A | 12/1981 | Spaulding | 339/122 R |
| 4,352,492 | A | 10/1982 | Smith | 273/1 GC |
| 4,407,559 | A | 10/1983 | Meyer | 339/126 R |
| 4,428,636 | A | 1/1984 | Kam et al. | 339/97 P |
| 4,710,136 | A | 12/1987 | Suzuki | 439/374 |
| 4,778,410 | A | 10/1988 | Tanaka | 439/676 |
| 4,915,648 | A | 4/1990 | Takase et al. | 439/490 |
| 5,035,641 | A | 7/1991 | Van-Santbrink et al. | 439/329 |
| 5,051,099 | A | 9/1991 | Pickles et al. | 439/108 |
| 5,139,439 | A | 8/1992 | Shie | 439/359 |
| 5,183,404 | A | 2/1993 | Aldous et al. | 439/55 |
| 5,184,282 | A | 2/1993 | Kaneda et al. | 361/395 |
| 5,336,099 | A | 8/1994 | Aldous et al. | 439/131 |
| 5,338,210 | A | 8/1994 | Beckham et al. | 439/131 |
| 5,391,094 | A | 2/1995 | Kakinoki et al. | 439/638 |
| 5,411,405 | A | 5/1995 | McDaniels et al. | 439/131 |
| 5,481,616 | A | 1/1996 | Freadman | 381/90 |
| 5,499,923 | A | 3/1996 | Archibald et al. | 439/26 |
| 5,505,633 | A | 4/1996 | Broadbent | 439/329 |
| 5,509,811 | A | 4/1996 | Homic | 439/55 |
| 5,538,442 | A | 7/1996 | Okada | 439/676 |
| 5,547,401 | A | 8/1996 | Aldous et al. | 439/676 |
| 5,561,727 | A | 10/1996 | Akita et al. | 385/88 |
| 5,562,504 | A | 10/1996 | Moshayedi | 439/638 |
| 5,608,607 | A | 3/1997 | Dittmer | 361/686 |

(List continued on next page.)

FOREIGN PATENT DOCUMENTS

| | | |
|---|---|---|
| EP | 0 355 413 | 7/1989 |
| JP | 58-34370 | 5/1983 |
| JP | 61-256850 | 11/1986 |
| WO | WO 95/13633 | 5/1995 |

OTHER PUBLICATIONS

IBM Technical Disclosure Bulletin, "Electrical Connector For Flat Flexible Cable," vol. 25, No. 1, Jun. 1982.

*Primary Examiner*—P. Austin Bradley
*Assistant Examiner*—Alexander Gilman
(74) *Attorney, Agent, or Firm*—Workman, Nydegger & Seeley

(57) ABSTRACT

An extendable media connector for coupling a physical/electrical media plug to an electrical apparatus either directly or indirectly via a communications device. The extendable media connector is slidably retractable and has a frame with an aperture extending therethrough and a rocker arm mounted thereon. The rocker arm is configured to capture a retention clip mounted on the media plug to securely latch the media plug to the extendable media connector. The rocker arm also has alignment arms configured to engage the sides of the retention clip so that the connection between the media plug and the extendable media connector is aligned and tight even if the aperture is wider than the body of the media plug. The connection between the extendable media connector and the plug includes biasing electrical contacts connected to internal circuitry of the electrical apparatus against contact pins of the media plug.

24 Claims, 8 Drawing Sheets

U.S. PATENT DOCUMENTS 5,634,802 A 6/1997 Kerklaan ..... 439/131
5,660,568 A 8/1997 Moshayedi ..... 439/654
5,667,390 A 9/1997 Keng ..... 439/76.1
5,667,395 A 9/1997 Okada et al. ..... 439/131
5,679,013 A 10/1997 Matsunaga et al. ..... 439/144
5,727,972 A 3/1998 Aldous et al. ..... 439/655
5,773,332 A 6/1998 Glad ..... 439/344
5,797,771 A 8/1998 Garside ..... 439/610
5,816,832 A 10/1998 Aldous et al. ..... 439/131

LOW PROFILE CONNECTOR WITH EXTENDING LATCH MECHANISM

BACKGROUND OF THE INVENTION

1. The Field of the Invention

The present invention relates to electrical interface connections. More particularly, it relates to media connectors configured to couple with a physical/electrical media plug.

2. Related Technology

The field of data transmissions over phone lines or network cables is a rapidly expanding field. Users of electrical apparatus such as laptops, notebooks, palmtops, and PDAs are finding such practice to be of great value.

For example, there are numerous public and private networks and databases which store data or programs. Absent the ability to connect with such systems over the telephone lines, a user is relegated to relying upon the exchange of discs or tapes in order to receive data suitable for use with their computer.

Similarly, companies performing tasks that are integrated are aided by local area networks ("LANs") which permit personnel to exchange electronically retrievable data. The ability to freely transfer data and information from one computer to another computer over a telephone line or cable can dramatically increase productivity and reduce overall production time.

Furthermore, the increased use of palmtops and PDAs has increased the need to transfer data between such apparatus and other computers, particularly personal computers. This enables a user to quickly transfer information, such as telephone or address lists, without having to make manual entries.

The interface between a computer and a cable or telephone line is typically accomplished through a physical/electrical media connector. One conventional type of media connector is the RJ-type connector. RJ-type connectors are used by almost all telephone companies throughout the world for many applications, the most important of which is interconnection of telephones with telephone lines. For this reason, stringent standardization of connectors has been established to enable compatibility and interactivity. Due to the simplicity of the connection and the established standards, RJ-type connectors are used extensively in the computer industries and in other industries where communication over telephone lines or other types of cables is required.

RJ-type connectors include a plug or contact block and a receptacle or socket. The plug comprises a small block shaped body coupled with a cable, such as a telephone line. Housed within the body are several distinct metal contacts. Each of the metal contacts is attached to a discrete wire within the cable. Thin slots extend from the end of the body to each of the contacts. Mounted on the outside of the body is a flexible retention clip that is used for removably securing the plug within the socket of the electrical apparatus.

The socket is integrally formed on the side of the electrical apparatus and is configured to receive the plug. Disposed within the socket are flexible contact wires. The contact wires are oriented to be received within the corresponding slots of the plug when the plug is placed into the socket. The contact wires within the socket press against corresponding contacts on the plug to complete the electrical connection between the plug and the electrical apparatus.

The interior surface of the socket comprises the latching mechanism that receives the retention clip of the plug so as to mechanically secure the plug within the socket by holding retention notches of the retention clip. To remove the plug, the retention clip is manually flexed towards the body of the plug to release the hold of the latching mechanism on the retention notches, thereby enabling manual removal of the plug from the socket.

Although RJ type connectors are used extensively, they have several shortcomings. Most notably, the achievements in microprocessing have enabled manufactures to dramatically downsize various electrical apparatus. For example, mobile telephones and PDAs now exist that can easily fit in a shirt pocket. Such apparatus, however, are limited from further downsizing by the size of the socket in which the plug is received. That is, to enable an electrical apparatus to house a standard sized socket having a defined thickness, the electrical apparatus must have at least the same thickness.

Besides limiting the size of an electrical apparatus, a socket housed within an electrical apparatus occupies valuable space. Even in larger apparatus it is desirable to optimize the use of space so as to minimize size. When an electrical apparatus does not need to couple with a plug, the space occupied by the coupling socket is wasted.

As electronic communications devices have continued to be downsized, so have peripheral communications devices. A typical communications device is a PCMCIA card.

Standards have been promulgated by the Personal Computer Memory Card International Association (PCMCIA) for PCMCIA cards which are widely accepted. These standards include spatial size restrictions of approximately 55 mm in width, 85 mm in length, and 5 mm in depth. In keeping with these standards, various manufacturers build communications devices that meet these specifications. Electronic apparatus have also been configured with expansion slots for receiving these various communications devices.

Because these communications devices are narrower than the typical RJ-series media plugs used to connect to communications devices, adapters were required. One skilled in the art should recognize a dongle as a typical adapter. However, this caused problems because the dongle had to be stored and could easily be misplaced. A solution to this problem was developed by the innovation of expandable media connectors, as embodied in U.S. Pat. No. 5,183,404, issued to Aldous et al. Extendable media connectors have a profile that is thinner than the media plug being connected to the electrical apparatus and can be slidably retracted into the housing of the communications device. Extendable media connectors can also be directly connected to an electronic apparatus.

One problem encountered by extendible media connectors is the insertion depth of the plug when it couples with the extendable media connector. In particular, the nose of the plug can extend beyond the bottom of the extendable media connector and cause snagging of the plug with other objects such as a bedspread or a sheet. The depth of a PCMCIA standard communications device is limited to 5 mm. However, the depth of a media connector such as the RJ-type plug is approximately 8–12 mm.

The insertion depth of the media plug can also be problematic when the media plug is connected to a first communications device that is stacked on top of a second communications device, such as within a double bay expansion slot of an electrical apparatus.

It is common in the industry to stack communications devices within an electrical apparatus to maximize the capacity of the electrical apparatus by incorporating various hardware and communications devices. This is particularly true for portable computers. It is also typical for a portable computer to be configured with a double bay expansion slot for receiving stacked communications devices. By way of example, and not limitation, an exemplary stacking configuration of communications devices within a typical double bay expansion slot might include a PCMCIA card stacked above a network interface card.

Various communications devices are suitably configured for being stacked in a double bay expansion slot, including, but not limited to PCMCIA cards, network interface cards, wireless cellular cards, sound cards, memory cards, and peripheral device controller cards. Although stacking communications devices does increase the capacity of the electrical apparatus to incorporate various communications devices, it can also prevent simultaneous use of the communications devices, in a sense, defeating the purpose of stacking the communications devices.

Use of a second communications device in a stacked configuration cannot be used when the coupling of a media connector with a first communications device obstructs the coupling of another media plug with the second communications device. For example, the nose of an RJ-series media plug coupled with an extendible media connector of a typical PCMCIA card may extend into the space required by a second communications device for coupling with a suitable media plug. Even if a thinner media plug adapter, such as a dongle is used, the extension of the RJ-series media plug may extend too far down into the space required by the dongle for connecting into the second communications device. Accordingly, if communications devices are stacked, it may only be possible to use one of the communications devices at any given time.

The flexible contact wires of an extendible media connector can also potentially cause problems if they are configured to extend into the socket that receives the body of the media plug. This configuration is recognized in the industry as one method for positioning the contact wires to be received within corresponding slots of the plug when the plug is inserted into the socket. However, with this configuration there is a risk that when the plug is inserted into the socket that the contact wires will be forced out of a protective profile of the extended media connector, increasing the possibility of causing an electrical short of the contact wires.

Some media connectors have been configured to receive both RJ-11 series plugs and RJ-45 series plugs. An RJ-11 series plug has six metal contacts whereas the RJ-45 series plug has 8 metal contacts. Accordingly, the media connectors configured for receiving both types of plugs are equipped with 8 contact wires, to accommodate either plug. However, when an RJ-11 series plug is coupled with a media connector having 8 contact wires, only six contact wires are engaged within the slots of the plug. The remaining contact wires, if they extend into the socket, are susceptible to being damaged when they encounter high profile comers of the media plug. They are also more susceptible to being displaced beyond the protective profile of the extendable media connector by the high profile edges of the plug.

Another problem encountered by extendable media connectors that accommodate both RJ-11 series plugs and RJ-45 series plugs is assuring the stability of the connection between the plug and the extendable media connector. In particular, the width of the aperture configured for holding the plug must be at least as wide as the RJ-45 series body, which is slightly wider than the body of an RJ-11 series plug. This can create a loose connection when an RJ-11 series plug is inserted into the socket of such a media connector because the additional wiggle room between the sides of the plug and the socket.

It would, therefore, be desirable to have an extendable media connector that can securely couple with both RJ-11 and RJ-45 series plugs. It would also be desirable to accomplish such a coupling while minimizing the protrusion of the plugs through the bottom of the extendable media connector. It is further desirable to achieve this result without damaging the contact wires of the extendable media connector.

SUMMARY OF THE INVENTION

An extendable media connector is provided for coupling with RJ-series media plugs. The extendable media connector can be directly attached to an electrical apparatus, such as, a laptop, notebook, palmtop, PDA, pager, modem, and telephone. The extendable media connector can also be indirectly attached to an electrical apparatus via a communications device, such as, a PCMCIA card, network interface card, wireless cellular card, sound card, memory card, and other peripheral device controller cards. Non-conventional electrical apparatus can include televisions, stereo equipment, automobiles, and appliances.

The RJ-series plug comprises a small block shaped body coupled with a cable, such as a telephone line. The body of the plug has a nose extending away from the body in the opposite direction of the cable. A flexible retention clip is mounted to the nose of the body, and protrudes away from the plug body at a slight angle, terminating at a narrow free end. The retention clip has retention notches that define the edges where the retention clip significantly narrows. Housed within the plug body are distinct contact pins. Each of the contact pins are attached to discrete wires within the cable. Thin slots extend from the end of the plug body to each of the contact pins.

The extendable media connector comprises a frame and a rocker arm. The frame has an aperture formed therein. The aperture is configured to receive an RJ-series media plug. A plurality of contact wires are housed within protective slots of the frame and are exposed to the aperture. During use, the plug is inserted into the aperture so that the contact wires of the extendable media connector are biased against the contact pins of the plug, thereby effecting electrical communication between the media plug and the communications device through the extendable media connector. This direct connection obviates the need for conventional adapters to facilitate connection of the media plug to the electronic apparatus.

One of the unique benefits of using the extendable media connector is that the extendable media connector can be constructed having a thickness significantly smaller than the thickness of an RJ-series media plug. For example, by forming the aperture completely through the frame of the extendable media connector, the opposing ends of the media plug inserted therein can freely project from opposing sides of the aperture block. However, it is desirable to limit projection of the media plug out of the bottom side of the extendable media connector to avoid particular problems that will be addressed herein. These problems include obstructing the successful connection of a media plug with the same electronic apparatus or another communications device and snagging on other materials such as bedspreads. To overcome these problems, the frame comprises insertion stopping means comprising tabs that project away from the frame and into the aperture. These tabs control the insertion depth of the media plug by catching recessed surfaces of the media plug, preventing the plug from passing completely through the aperture.

The extendable media connector can be designed in a variety of alternative embodiments, comprising alternative insertion stopping means. For example, the extendable media connector may alternatively comprise stirrups, diaphragms, faceplates, or other retention structures that can be attached to the aperture block to prevent the passage of the media plug through the bottom of the extendable media connector.

The frame of the extendable media connector need only be thick enough to structurally support the media plug and securely hold the contact wires. Accordingly, use of the extendable media connector enables the use of peripheral communications devices and the manufacture of thinner electrical apparatus. The frame of the extendable media connector can also be retracted so as to be out of the way. A mechanism slidably connects the frame of extendable media connector to the communications device or electronic apparatus. This mechanism enables the extendable media connector to be selectively retracted into the casing of the communications device or electronic apparatus, or selectively extended out of the casing.

A rocker arm is pivotally mounted on the frame of the extendable media connector for mechanically latching onto an RJ-series media plug. The rocker arm has a foot that is configured for receiving a contact force from the plug. When the plug is inserted into the aperture, the nose of the plug is pushed against a base of the rocker arm, causing the rocker arm to rotate. The rocker arm also has two alignment arms that slidably engage the sides of the retention clip of the plug, holding the plug in a predetermined alignment. This is important to assure a tight connection between the plug and the extendable media connector, particularly when the aperture of the extendable media connector is wider than the body of the plug. Because the width of the retention clip for both the RJ-11 and RJ-45 series plugs is the same, an equally aligned and tight connection is assured for both types of plugs, regardless of the width of the aperture of the extendable media connector.

The alignment arms of the plug have rotation stop surfaces for stopping the rotation of the rocker arm when they come in contact with the body of the plug. The rocker arm is also configured for mechanically securing the media plug within the aperture of the extendable media connection. In one embodiment, the rocker arm comprises locking ears that are located on the ends of the alignment arms. The locking ears mechanically latch onto retention notches of the retention clip, securely holding the plug within the aperture. To remove the plug from the aperture, the retention clip is manually flexed towards the body of the plug. This action releases the hold of the locking ears on the retention notches, thereby enabling manual removal of the plug from the extendable media connector. The rocker arm can also be designed in a variety of alternative embodiments without departing from the spirit of the present invention.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Figure 1:
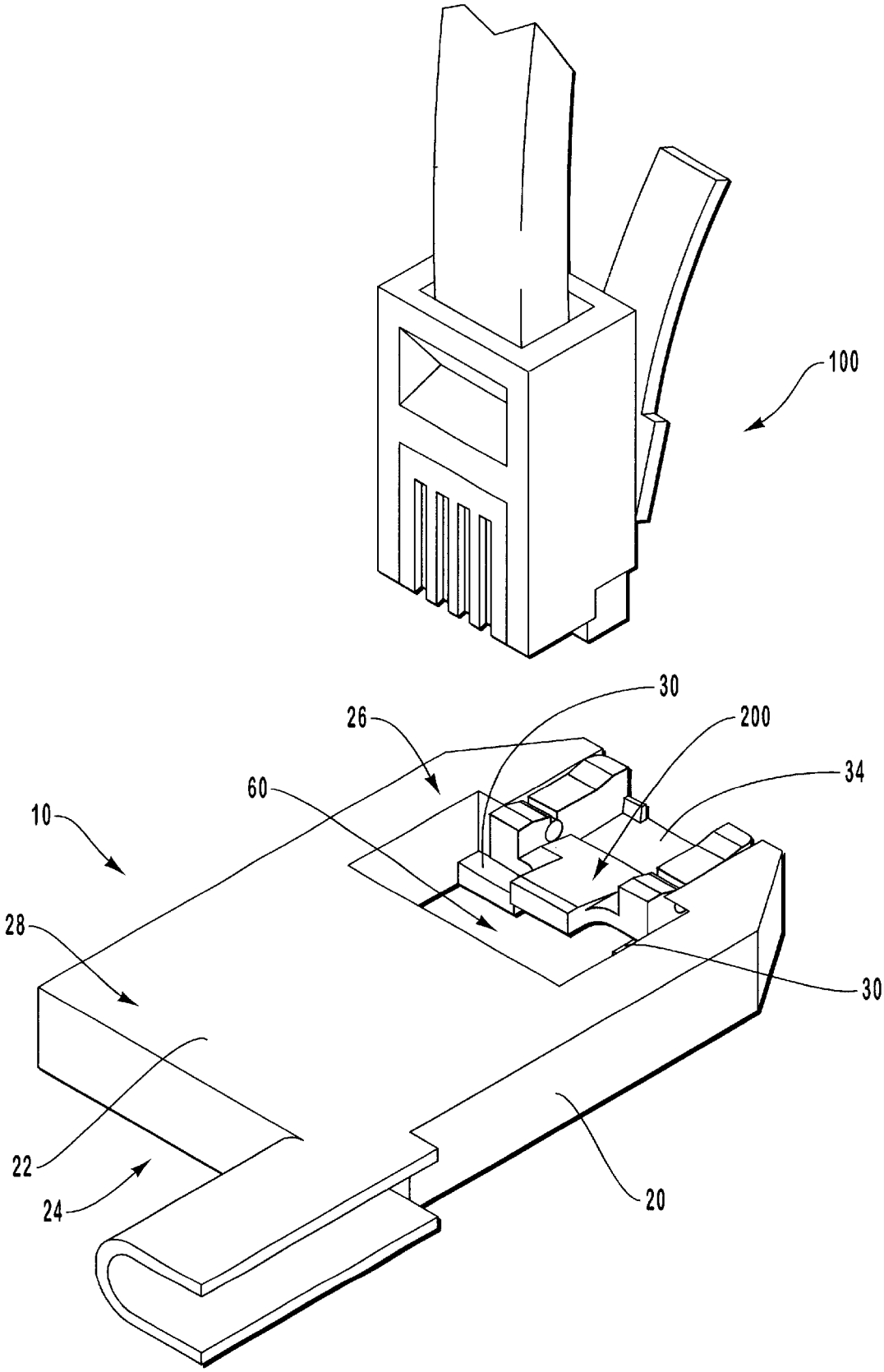
FIG. 1 is a perspective top view one presently preferred embodiment of the extendable media connector of the present invention that includes a frame, a rocker arm and electrical contacts.

The present invention relates to physical/electrical media connectors used to both physically and electrically connect a wire, such as a telephone wire or electrical cable, to an electrical apparatus either directly or indirectly via a communications device. Preferred physical/electrical media connectors are those that contain the attributes described in F.C.C. Part 68, subpart F. The physical/electrical media connectors of the present invention, however, are not limited by the F.C.C. standards and may fall outside such standards as the need dictates or as the standards change.

Physical electrical media connectors as used herein include a physical/electrical media plug, hereafter "media plug." Examples of conventional media plugs are the RJ-11, RJ-45, RJ-type, 6-pin miniature modular plug, and 8-pin miniature modular plug. The media plugs of the present invention are also intended to include nonstandard plugs and plugs that are developed or standardized in the future.

The extendable media connector of the present invention is configured to electrically and mechanically receive a corresponding media plug. The extendable media connector of the present invention is also configured to be able to slidably retract into the casing of an electrical apparatus or a communications device. Although many of the depicted examples of inventive extendable media connectors are configured to receive RJ-11 and RJ-45 series plugs, the present invention contemplates that it would be obvious to one skilled in the art based on the present disclosure to modify the depicted aperture blocks to receive any media plug configuration.

To prevent the coupling of a media plug with the extendable media connector from obstructing other electrical connections, the insertion depth of the media plug should be limited. The insertion depth of the media plug is defined as the distance between the top of the extendable media connector and the end of the plug having been received by the extendable media connector.

The term "electrical apparatus," as used in the specification and appended claims, is broadly intended to include any apparatus having electrical components. By way of example and not limitation, some of the more conventional electrical apparatus include: network computers, laptop computers, personal computers, notebook computers, palm top computers, PDA's, telephones, modems, televisions, stereos, pagers, electrical tools, electrical appliances, and automobiles. The function that the corresponding media connector serves may be vastly different depending on the type of electrical apparatus. For example, the media connector may be used for transferring data or diagnostic testing.

The term "communications device," as used in the specification and appended claims, is broadly intended to include any thin-architecture communications card having a thickness less than the cross-section of a media plug. The term "cross-section of a media plug" means the width and height of the media plug when viewed from the end which is inserted into the aperture. By way of example, and not limitation, some of the more conventional communications devices include: PCMCIA cards, network interface cards, wireless cellular cards, sound cards, and peripheral device controller cards.

Depicted in FIG. 1 is one presently preferred embodiment of an extendable media connector 10 of the present invention. Extendable media connector 10 comprises a frame 20 having a top side 22, a bottom side 24, a front side 26, and a back side 28. The frame 20 also includes tabs 30 and ledge 34. Ledge 34 is located on the front side 26 of the frame 20. Ledge 34 is recessed from the top side 22 and extends up from the bottom side 24 of the frame 20. The back side 28 of the frame 20 can also be configured to comprise channels for sheltering electrical contacts 50, not shown in FIG. 1, and for engaging corresponding slots of a media plug. Frame 20 also defines the boundaries of an aperture 60. The aperture 60 extends from the top side 22 of the frame 20 to the bottom side 24 of the frame 20 and is configured for receiving a media plug 100. Extendable media connector 10 also comprises rocker arm 200.

In one presently preferred embodiment electrical contacts 50 are exposed to the aperture 60. It is possible for the electrical contacts 50 to protrude into the aperture, but this may not be desirable because this increases the exposure of the electrical contacts to the possibility of shorting or ancillary damage when the electrical contacts are displaced beyond a protective profile of the extendable media connector 10.

A particular reason for having the electrical contacts protrude into the aperture is because the extendable media connector of the present invention can be accommodated to receive various types of physical/electrical media plugs such as RJ-11 and RJ-45 series plugs. To accommodate both RJ-11 and RJ-45 plugs the extendable media connector will comprise at least 8 electrical contacts corresponding to the number of contact pins on an RJ-45 plug. If an RJ-11 plug, requiring only six electrical contacts, engages the aperture having protruding electrical contacts then the media plug may displace the electrical contacts below the protective profile of the extendable media connector, making them more susceptible to shorts and ancillary damage.

Each electrical contact 50 is connected to a contact wire that is housed within the frame and extends into the communications device. During use, a media plug is inserted into the aperture 60 so that the electrical contacts 50 of the extendable media connector 10 are biased against contact pins of the plug, thereby effecting electrical communication between the media plug and the electrical apparatus through the extendable media connector 10.

Figure 2:
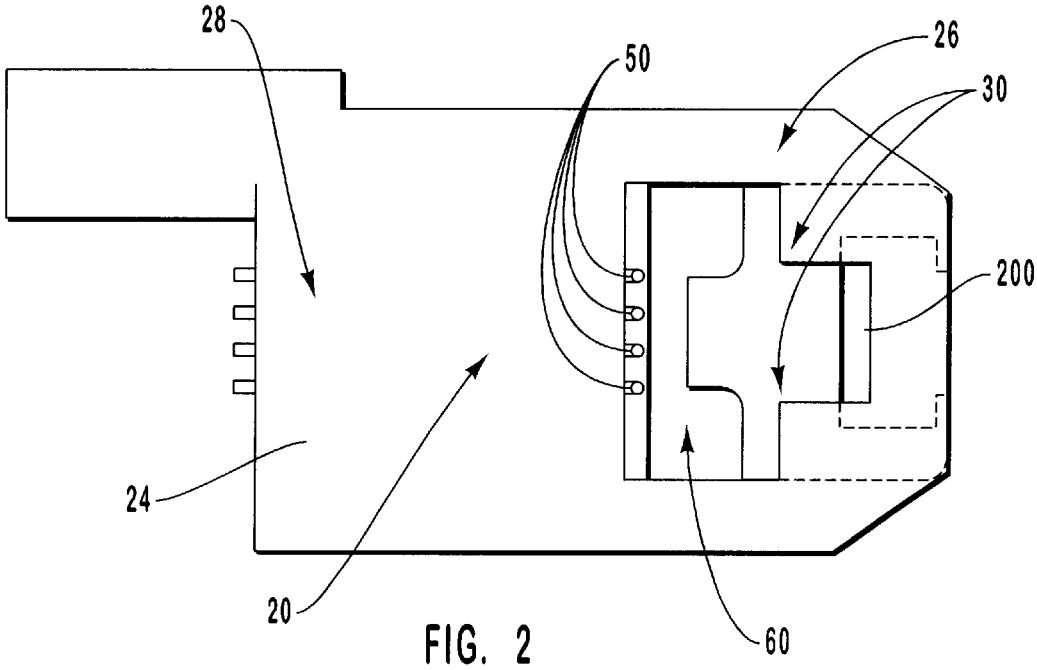
FIG. 2 illustrates a bottom view of one presently preferred embodiment of the extendable media connector of the present invention.

FIG. 2 illustrates a bottom view of the same presently preferred embodiment of the extendable media connector 10 of the present invention. Tabs 30 are illustrated to protrude into the aperture 60. This protrusion creates a smaller profile of aperture 60 along the bottom side 24 of the frame 20 than along the top side 22 of the frame 20, enabling the tabs 30 to effectively obstruct passage of the media plug through the bottom side 24 of the aperture 60.

The tabs 30 prevent the media plug from passing through the bottom side 24 of the frame 20 when they engage retention edges of the media plug. Accordingly, the insertion depth of the media plug will be predetermined by the location of the tabs 30. In some instances, as will be described more thoroughly throughout, it is desirable to limit the insertion depth of the media plug.

Figure 3:
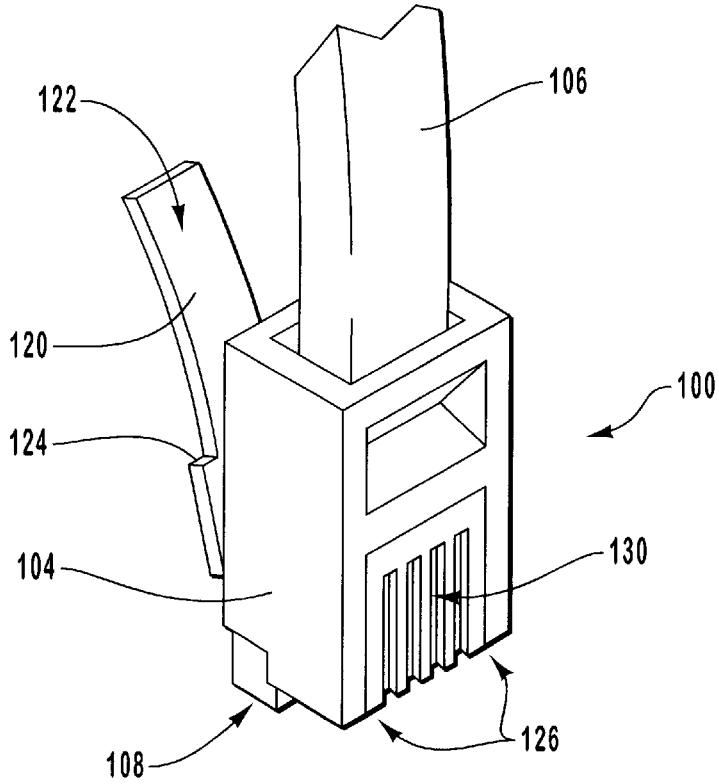
FIG. 3 is a perspective side view of one embodiment of a physical/electrical media plug.

A typical embodiment of a media plug 100 is illustrated in FIG. 3. As shown, the media plug 100 comprises a small block shaped body 104 coupled with a cable 106, such as a telephone line. The plug body 104 has a plug nose 108 extending away from the body 104 in the opposite direction of the cable 106. A flexible retention clip 120 is mounted on the plug nose 108 that protrudes away from the plug body 104 at a slight angle, terminating at a narrow free end 122. The retention clip 120 has retention notches 124 that define the edges where the retention clip 120 significantly narrows. The plug body 104 also has high profile edges 126, as described earlier, that can potentially deflect unused electrical contacts 50 out of a protective profile if they are protruding into the aperture 60. Housed within the plug body 104 are distinct contact pins 130. Each of the contact pins 130 are attached to discrete wires within the cable 106. During use, the media plug 100 is inserted into the aperture 60 so that the electrical contacts 50 of the extendable media connector 10 are biased against the contact pins 130 of the media plug 100, thereby effecting electrical communication between the media plug 100 and the communications device through the extendable media connector 10.

Figure 4:
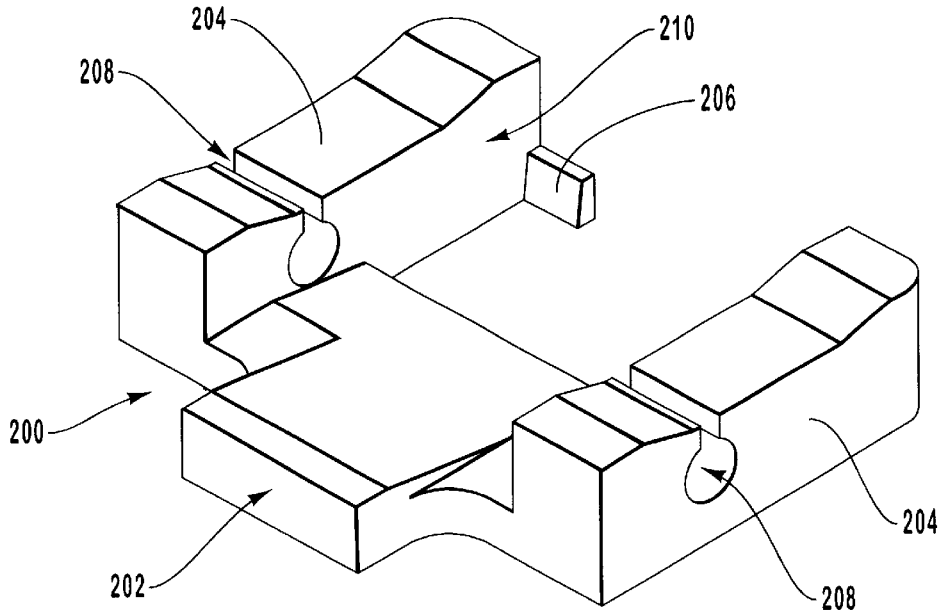
FIG. 4 illustrates a perspective top view of one presently preferred embodiment of the rocker arm.
Figure 5:
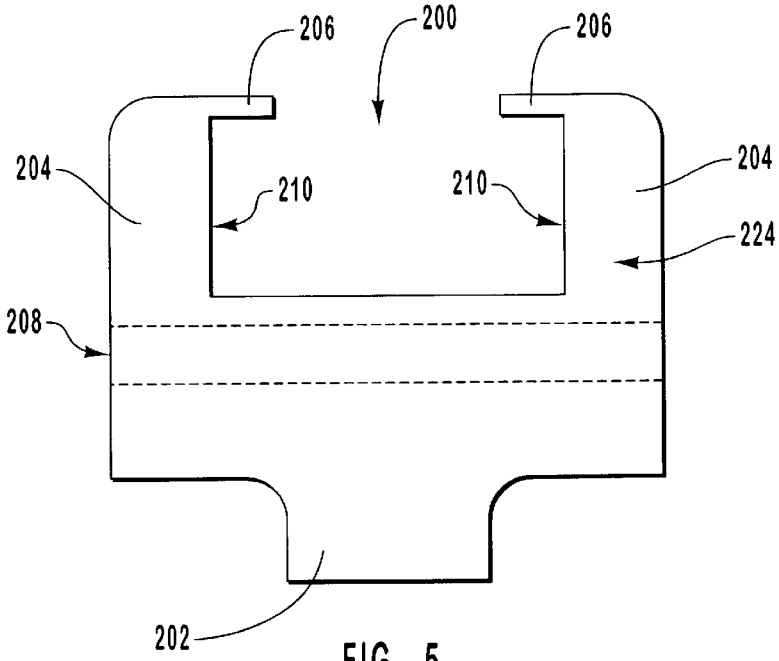
FIG. 5 illustrates a bottom view of one presently preferred embodiment of the rocker arm of the present invention.
Figure 6:
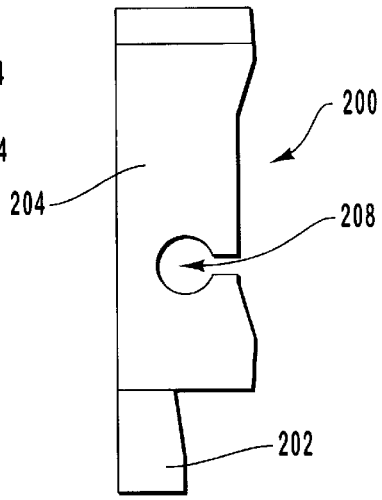
FIG. 6 illustrates a side view of one presently preferred embodiment of the rocker arm of the present invention.

FIGS. 4 thru 6 illustrate one presently preferred embodiment of the rocker arm 200. As illustrated, rocker arm 200 comprises a base 202 that acts as a tiebar effectively joining alignment arms 204. The base in configured for receiving a contact force from a media plug 100. Each alignment arm 204 has locking ears 206 for mechanically latching onto the retention notches 124 of the retention clip 120 of the media plug 100. Each alignment arm 204 also comprises a mounting component 208 for pivotally mounting the rocker arm 200 to the frame 20. In this embodiment the mounting components 208 comprise recesses that are configured for receiving a pin or other structure attached to the frame 20 for pivotally mounting the rocker arm 200 to the frame 20 of the extendable media connector 10. Alignment surfaces 210 are configured for slidably engaging the sides of the retention clip 120. This is an important feature for reasons that will be addressed below.

Figure 7:
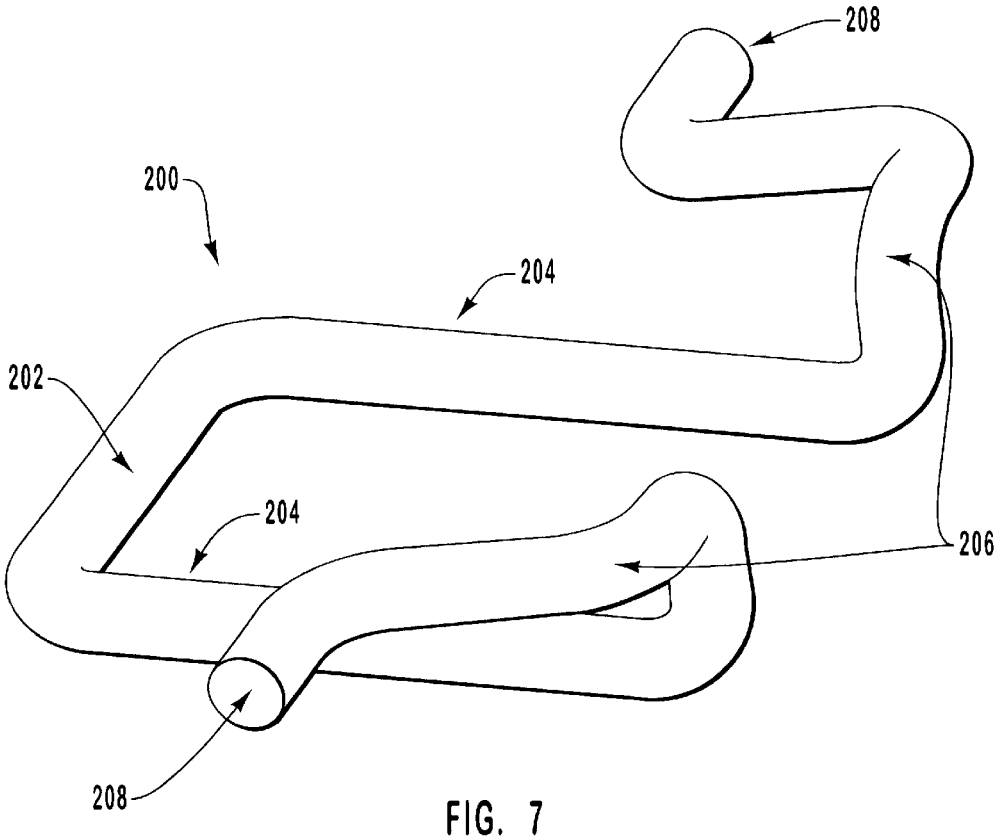
FIG. 7 illustrates a perspective top view of one alternative embodiment of the rocker arm of the present invention.

FIG. 7 illustrates an alternative embodiment of the rocker arm 200 of the present invention. In this embodiment, the base 202, the mounting components 208, the alignment arms 204, and the locking ears 206 are each defined as sections along a single shaped wire having a uniform diameter. In this embodiment the ends of the wire are used as the mounting components 208 for pivotally mounting the rocker arm 200 to recesses that can be formed in the frame 20 of the extendable media connector 10. One advantage of this embodiment is that it is relatively inexpensive to manufacture. Another advantage of this embodiment is that the rocker arm 200 can be easily removed and replaced. This feature is particularly advantageous because it allows the rocker arm 200 to be effectively snapped out of its mounting in the frame 20 without damaging the frame 20 when a destructive force is applied to the rocker arm 200.

Figure 8:
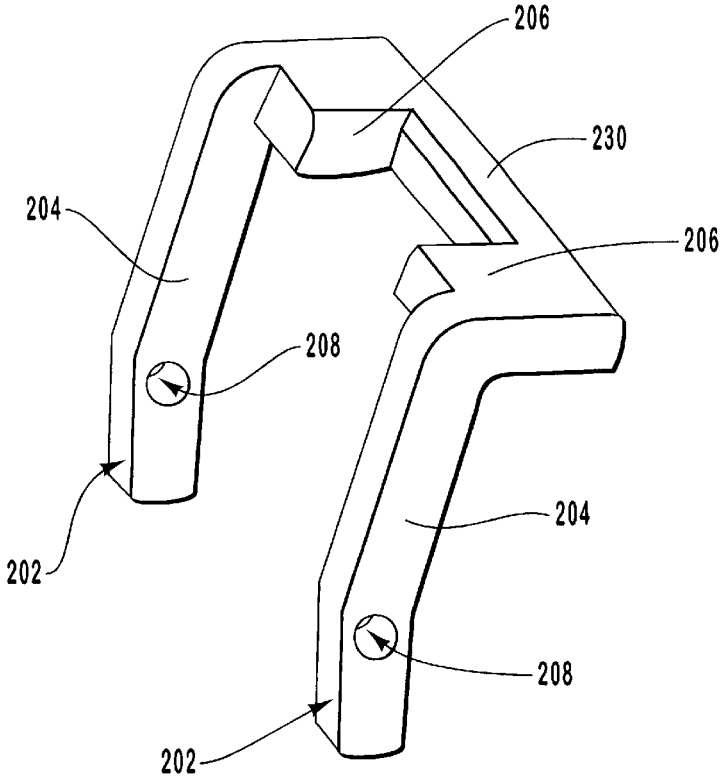
FIG. 8 illustrates a perspective top view of another alternative embodiment of the rocker arm of the present invention.

FIG. 8 illustrates yet another embodiment of the rocker arm 200. In this embodiment, a tiebar 230 effectively joins the alignment arms 204 and provides additional stability to the alignment arms 204. Another advantage of this embodiment is the relatively basic design which also lowers manufacturing costs. In this embodiment, mounting components 208 are configured for receiving a pin or protrusion extending out of the frame for pivotally mounting the rocker arm 200 to the frame 20. However, it should be appreciated that any suitable means for pivotally attaching the rocker arm 200 to the frame 20 can be used. Such other means may include, but are not limited to, protrusions extending out of the respective alignment arms 208 that can be placed into recesses formed within the frame 20.

Each of the embodiments of the rocker arm described above have several features in common. They each have mounting components 208 for pivotally mounting the rocker arm 200 to the frame 20. They also each have a base 202 that is configured for receiving a contact force from a media plug 100. When the base 202 of the rocker arm 200 receives a contact force, the rocker arm 200 is rotated about an axis that extends between the mounting components 208 of the rocker arm 200. Another important feature of the rocker arm 200 is that the alignment arms 204 are configured for slidably engaging the sides of the retention clip 120 when the media plug 100 is placed into the aperture 60 of the extendable media connector 10.

It should be appreciated by one skilled in the art that this is one advantage of the present invention because it assures a solid connection between the media plug 100 and the extendable media connector 10 even if the aperture 60 receiving the media plug 100 is wider than the body 104 of the media plug 100. In particular, it prevents the media plug 100 from being wiggled back and forth in such a way as to disconnect the pins 130 of the media plug 100 from the electrical contacts 50 of the extendable media connector 10.

Having the alignment arms 204 configured for slidably engaging the sides of the retention clip 120 also allows a single extendable media connector 10 to accommodate various media plugs 100 having different body widths, as long as the width of the retention clip 120 is the same for each of the various media plugs 100. This is the case for RJ-11 and RJ-45 plugs, for example, even though the body of the RJ-45 series plug is wider than that of the RJ-11 series plug. Nevertheless, both the RJ-11 and the RJ-45 series plugs can be securely coupled with the same extendable media connector 10 of the present invention, regardless of the width of the aperture 60 of the extendable media connector 10.

The material composing the rocker arm 200 can be any suitable material including various plastics and metals. The methods for manufacturing the rocker arm 200 vary depending on the design and the materials that are selected. Possible techniques for manufacturing the rocker arm 200 include, but are not limited to injection molding, casting, metal injection molding and wireforming.

Figure 9:
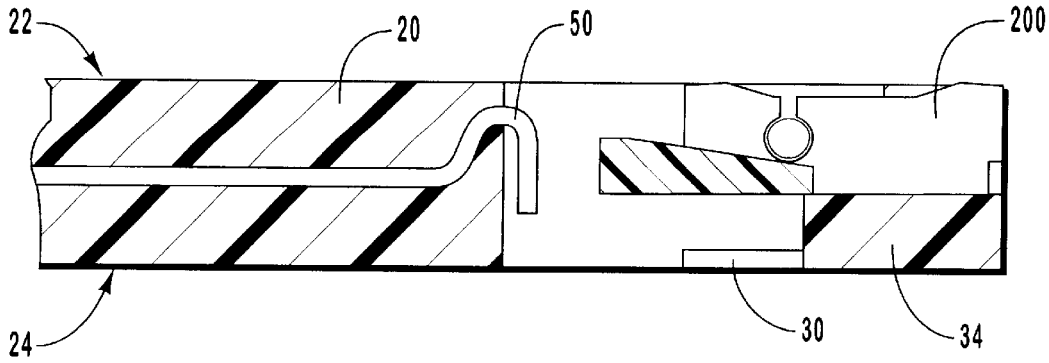
FIG. 9 is a cross-sectional side view of one presently preferred embodiment of the extendable media connector of the present invention that includes having the rocker arm in a horizontal position.

FIG. 9 illustrates a cross-sectional side view of one presently preferred embodiment of the extendable media connector 10. In this illustration, the rocker arm 200 is laying in a horizontal position so that the rocker arm 200 rests against the ledge 34. This is the default position of the rocker arm 200. In this position the profile of the rocker arm 200 does not extend beyond the profile of the frame 20. This is important because it allows the frame 20 to be retracted into the housing of the communications device which is narrower than the body of the media plug 100 or an electronic apparatus. If the rocker arm 200 were to extend beyond the profile of the frame 20 than the rocker arm 200 would prevent the frame 20 from being retracted into the communications device.

Figure 10:
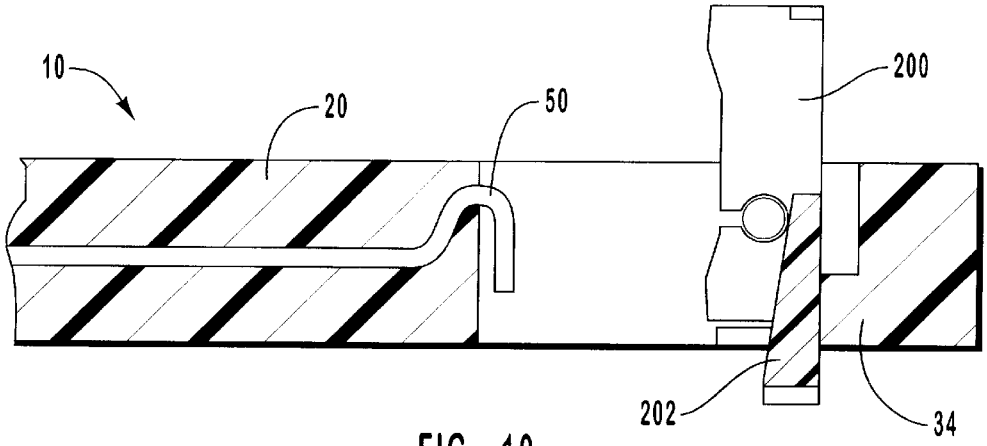
FIG. 10 is a cross-sectional side view of one presently preferred embodiment of the extendable media connector of the present invention that includes having the rocker arm in a vertical position.
Figure 11:
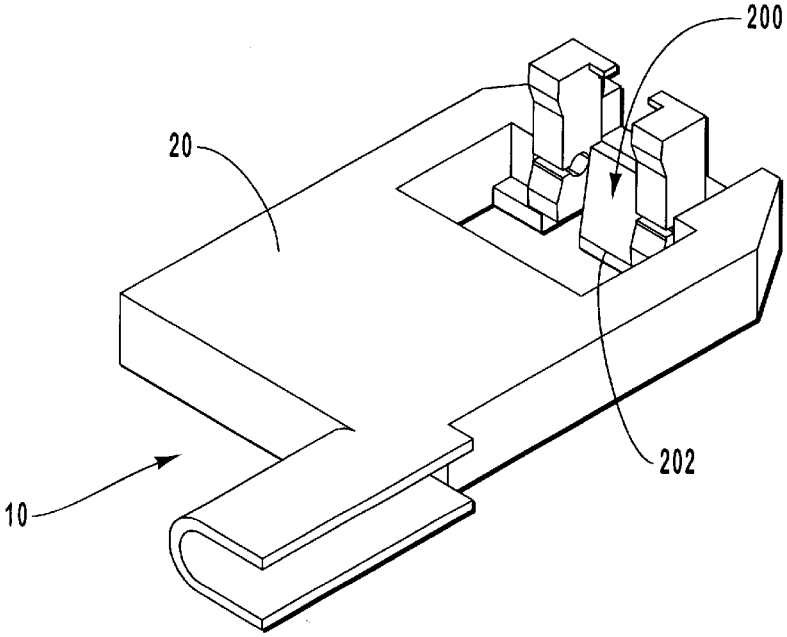
FIG. 11 is a perspective top view one presently preferred embodiment of the extendable media connector of the present invention that includes having the rocker arm in a vertical position.

FIGS. 10 and 11 illustrate a presently preferred embodiment of the extendable media connector with the rocker arm 200 in a vertical position. This is the position of the rocker arm 200 when a media plug 100 engages the aperture 60 of the extendable media connector 10. In this position the base 202 of the rocker arm 200 is biased against the ledge 34. When the media plug 100 is removed from the aperture 60 then the rocker arm 200 is returned to its default position shown in FIG. 9. The rocker arm 200 can be returned to the default position either manually or mechanically. Any suitable mechanical means can be supplied. One exemplary means which is given by way of example, and not limitation, is a spring fastened to the mounting component 208 and the frame 20.

Figure 12:
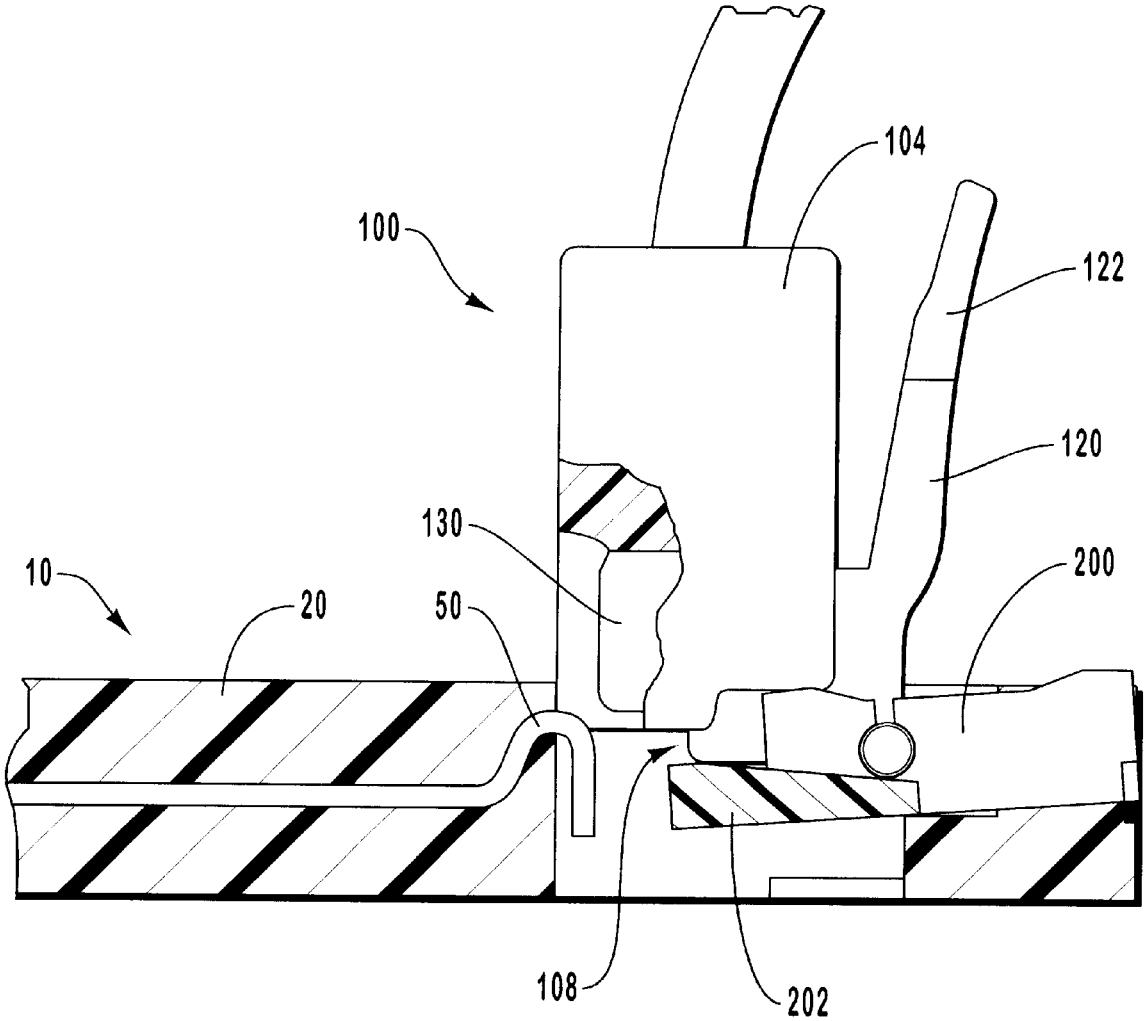
FIG. 12 is a cross-sectional side view of a physical/electrical media plug partially received within the aperture of one presently preferred embodiment of the extendable media connector of the present invention.

FIG. 12 illustrates how a media plug 100 initially engages the extendable media connector 10 of the present invention. As shown, the plug body 104 is positioned directly above the aperture 60 and the plug nose 108 engages the base 202 of the rocker arm 200. From this position a downward force can be applied to the media plug 100. This force will be translated into a contact force that is applied to the base 208 of the rocker arm 200, causing the rocker arm 200 to pivot about the mounting components 208 of the rocker arm 200.

Figure 13:
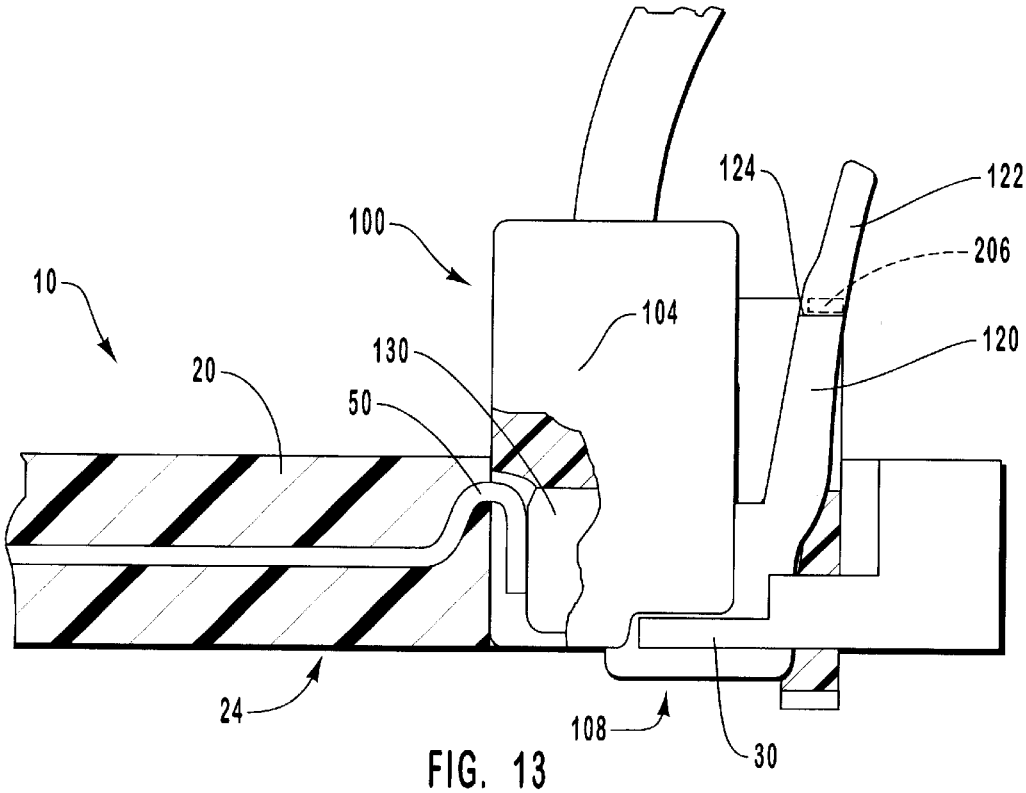
FIG. 13 is a partial cross-sectional side view of a physical/electrical media plug coupled with one presently preferred embodiment of the extendable media connector of the present invention that includes having one presently preferred embodiment of the rocker arm latched onto the retaining clip of the physical/electrical media plug.
Figure 14:
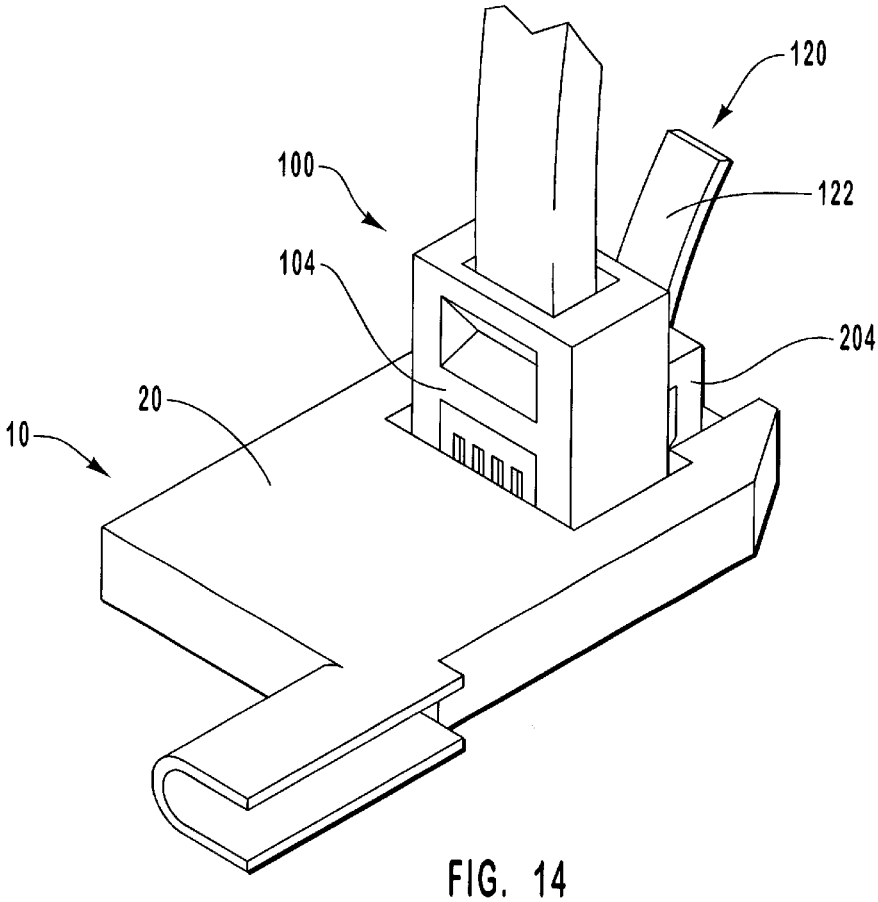
FIG. 14 is a perspective top view of a physical/electrical media plug coupled with one presently preferred embodiment of the extendable media connector of the present invention that includes having one presently preferred embodiment of the rocker arm latched onto the retaining clip of the physical/electrical media plug.

FIGS. 13 and 14 illustrate a media plug 100 completely engaged within the aperture 60 of one presently preferred embodiment of the extendable media connector 10 of the present invention. As shown, the electrical contacts 50 of the extendable media connector 10 are physically connected to the contact pins 130 of the media plug 100. The locking ears 206 of the rocker arm 200 are latched onto the retention notches 124 of the retention clip 120. This mechanically secures the plug within the aperture 60 of the extendable media connector 10. The tabs 30 engage the recessed edges 102 of the media plug 100 to prevent the plug body 104 from passing completely through the bottom side 24 of the extendable media connector 10. As shown, only the plug nose 108 extends beyond the bottom side 24 of the frame 20. The distance between the plug nose 208 and the top side 22 of the frame 20 defines the insertion depth of the media plug 100. In some instances it is desirable to limit the insertion depth of the media plug 100.

This is particularly true when the media plug 100 is coupled to a first communications device that is stacked above a second communications device. Unless the insertion depth of the media plug 100 is limited, the media plug 100 may obstruct the coupling of the second communications device with another media plug 100. It is common in the industry to stack communications devices within a single electrical apparatus maximize the capacity of the electrical apparatus to incorporate various hardware and communications devices.

One skilled in the art will recognize it is possible to stack two communications devices in a double bay expansion slot of an electrical apparatus such as stacking a PCMCIA card on top of a network interface card. In this example, an RJ-series media plug 100 can be coupled with an extendable media connector 10 of the PCMCIA card. However, it is possible that access to the network interface card will be obstructed by the RJ-series media plug 100. Even if a dongle is used as an adaptive interface between the network interface card, the insertion depth of the RJ-series media plug 100 may be too deep to prevent the dongle from accessing a connector of the network interface card. Although the above discussion has gone into some detail with regards to a particular configuration of stacked communications devices, such should be construed as exemplary only and not as limiting the scope of this invention.

Because it is desirable to control the insertion depth of the plug 100, means are provided for limiting the insertion depth of the plug 100. By way of example and not limitation, insertion depth limiting means comprise tabs 30 which engage the recessed edges 102 of the media plug 100 and effectively stop the plug body 104 from passing through the bottom side 22 of the frame 20.

FIGS. 13 and 14 also illustrate how one presently preferred embodiment of the rocker arm 200 mechanically latches onto the retention clip 120 of the media plug 100. In particular, the locking ears 206 of the rocker arm 200 are biased against the retention notches 124 of the retention clip 120. To remove the media plug 100, a force is applied to the end 122 of the retention clip 120 towards the plug body 104. This force will remove the retention notches 124 from beneath locking ears 206 so that the media plug 100 can be freely removed from the extendable media connector 10.

Figure 15:
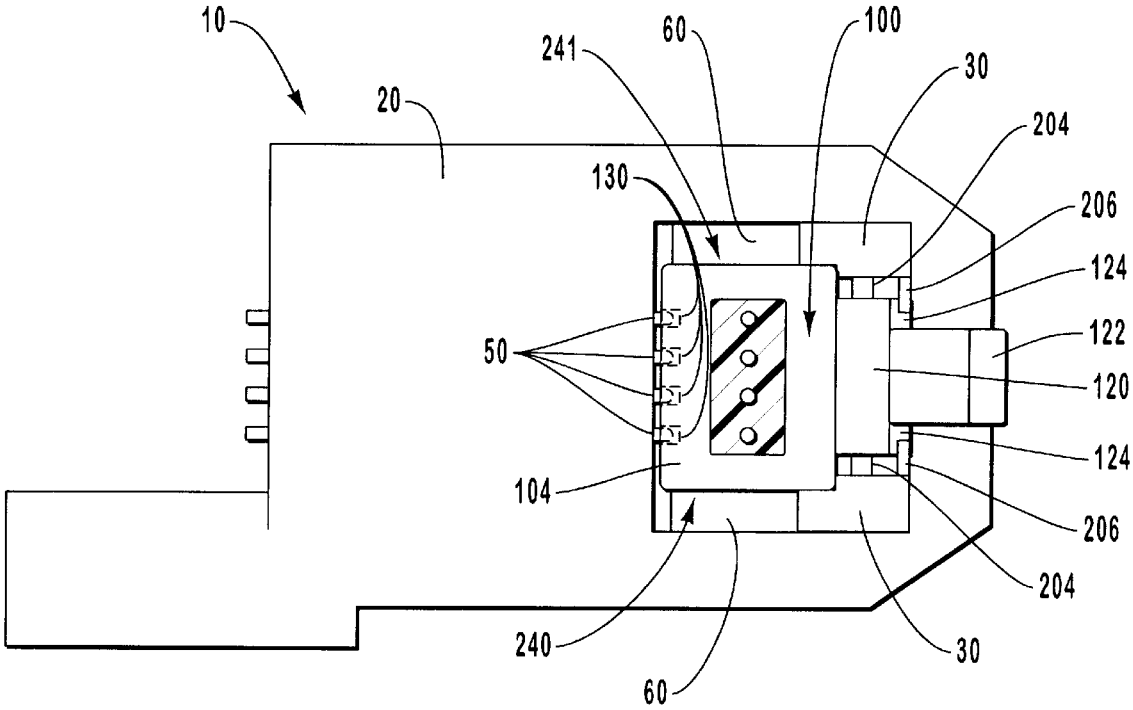
FIG. 15 is a top view of a physical/electrical media plug coupled with one presently preferred embodiment of the extendable media connector of the present invention that includes having one presently preferred embodiment of the rocker arm latched onto the retaining clip of the physical/electrical media plug.

FIG. 15 shows a top view of one presently preferred embodiment of the extendable media connector 10 of the present invention coupled with a media plug 100. As shown, the left side 240 and right side 241 of the plug 100 do not engage the frame 20. The space between the sides 240 and 241 of the plug body 104 and the frame 20 enable the extendable media connector 10 to accommodate various media plugs 100 having different body widths, as earlier described. The stability of the connection between the media plug 100 and the extendable media connector 10 is not compromised by this space between the plug body 104 and the frame 20 because the retention arms 204 of the rocker arm 200 slidably engage the retention clip 120 of an engaging media plug 100 to keep the plug body 104 from wiggling back and forth.

When a user wishes to connect a telephone line or other cable to an electrical apparatus having a communications device, the user removes the extendable media connector 10 from the communications device or electronic apparatus and inserts a media plug 100 into the aperture 60 of the extendable media connector 10. By doing this, electrical contacts 50 of the extendable media connector 10 engage the contact pins 130 of the media plug 100. This completes an electrical connection between the media plug 100 and electrical apparatus, as earlier described.

As the user inserts the media plug 100 into the aperture 60 a contact force is applied to the rocker arm base 202, causing the rocker arm 200 to rotate. As the plug body 104 is received into the aperture 60, the alignment arms 204 of the rocker arm 200 slidably engage the sides of the retention clip 120 of the media plug 100 ensuring alignment of the plug body 104. The rotation of the rocker arm 200 is stopped when the alignment arms 204 come in contact with the plug body 104 and when the base 202 engages the ledge 34 of the extendable media connector 10. As the media plug 100 is inserted into the aperture 60, the retention clip 120 is biased against the plug body 104 because of a compression force applied by the rocker arm 200.

The media plug 100 is finally latched into place when the locking ears 206 of the rocker arm 200 latch onto the retention notches 124 of the retention clip 120. This occurs when the plug is sufficiently received into the aperture 60 so as to allow the clip retention notches 124 to slip under the locking ears 206 of the rocker arm. The retention notches 124 are urged to do this by a force that was created in the retention clip 120 when it was pressed against the plug body 104. The plug body 104 is stopped from passing through the bottom side 24 of the frame 20 when tabs 30 of the frame 20 engage recessed edges 102 of the media plug 100.

When electrical communication between the electrical apparatus and the media plug 100 is no longer required, the media plug 100 is withdrawn from the aperture 60. To remove the media plug 100 from the aperture 60, the retention clip 120 is manually flexed towards the plug body 104. This action releases the hold of the locking ears 206 on the retention notches 124, thereby enabling manual removal of the media plug 100 from the extendable media connector 10.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. An apparatus that allows a RJ-type connector to be physically and electrically connected to an electrical apparatus, the RJ-type connector including a body and a retention clip, the apparatus comprising:

a frame including an upper surface, a lower surface, and an aperture extending through the upper surface and the lower surface, the aperture being sized and configured to receive at least a portion of the RJ-type connector;

one or more retention surfaces attached to the frame, the retention surfaces being sized and configured to generally prevent the RJ-type connector from passing through the lower surface of the frame when the RJ-type connector is inserted into the aperture; and a rocker arm pivotally mounted to the frame, the rocker arm comprising:

a base that is sized and configured to engage the RJ-type connector when the connector is being inserted into the aperture, the engagement of the RJ-type connector with the base causing the rocker arm to pivot relative to the frame;

first and second alignment arms connected to the base, the first and second alignment arms being sized and configured to slidably engage first and second sides of the retention clip; and first and second locking ears connected to the first and second alignment arms, the first and second locking ears being sized and configured to securely connect the RJ-type connector to the frame when the connector is inserted into the aperture.

2. The apparatus as in claim 1, further comprising mounting components attached to the rocker arm, the mounting components allowing the rocker arm to pivot between a first position in which the RJ-type connector is not received within the aperture and a second position in which the RJ-type connector is received within the aperture.

3. The apparatus as in claim 1, wherein the one or more retention surfaces comprise first and second tabs projecting inwardly into the aperture, the first and second tabs being sized and configured to engage recessed edges in the RJ-type connector.

4. The apparatus as in claim 1, further comprising one or more electrical contacts connected to the frame and being exposed in the aperture, the electrical contacts being sized and configured to be electrically connected to the RJ-type connector when it is received within the aperture.

5. The apparatus as in claim 1, wherein the RJ-type connector includes a nose portion located at a front end of the connector, the one or more retention surfaces being sized and configured to allow at least a portion of the nose to pass through the lower surface of the frame.

6. The apparatus as in claim 1, wherein the first and second alignment arms of the rocker arm are further configured for stopping rotation of the rocker arm.

7. The apparatus as in claim 1, wherein the base of the rocker arm includes a tiebar that connects the first and second alignment arms.

8. The apparatus as in claim 1, wherein the base of the rocker arm comprises a first deflection arm located on the first alignment arm and a second deflection arm located on the second alignment arm.

9. The apparatus as in claim 1, further comprising a slot formed in the electrical apparatus, the frame being slidably retractable into the slot between a first position in which the frame is completely or generally disposed within the electrical apparatus and a second position in which the frame is generally disposed outside of the electrical apparatus.

10. The apparatus as in claim 1, wherein the rocker arm further comprises a first protrusion and a second protrusion extending away from respective first and second alignment arms into recesses located in the frame for pivotally mounting the rocker arm on the frame.

11. The apparatus as in claim 1, wherein the rocker arm further comprises a pin extending through the first and second alignment arms into the frame for pivotally mounting the rocker arm on the frame.

12. A communications device for coupling with a media plug having a body and a retention clip, the communications device having a thickness generally less than a height or width of the media plug, the communications device comprising:

a body;

a retractable connector attached to the body, the retractable connector including an upper surface, a lower surface, and an aperture that is sized and configured to receive at least a portion of the media plug, the retractable connector movable between a first position in which the retractable connector is completely or generally disposed within the communications device and a second position in which the retractable connector is generally disposed outside of the communications device; and a rocker arm pivotally mounted to the retractable connector, the rocker arm comprising:

a base that is sized and configured to engage the media plug when the plug is being inserted into the aperture, the engagement of the media plug with the base causing the rocker arm to pivot relative to the frame;

first and second alignment arms connected to the base, the first and second alignment arms being sized and configured to slidably engage first and second sides of the retention clip; and first and second locking ears connected to the first and second alignment arms, the first and second locking ears being sized and configured to securely connect the media plug to the frame when the media plug is inserted into the aperture.

13. The communications device as in claim 12, further comprising mounting components attached to the rocker arm, the mounting components allowing the rocker arm to pivot between a first position in which the RJ-type connector is not received within the aperture and a second position in which the RJ-type connector is received within the aperture.

14. The communications device as in claim 12, further comprising one or more electrical contacts connected to the retractable connector and being exposed in the aperture, the electrical contacts being sized and configured to be electrically connected to the media plug when it is received within the aperture.

15. The communications device as in claim 12, wherein the media plug includes a nose portion located at a front end of the plug, the one or more retention surfaces being sized and configured to allow at least a portion of the nose to pass through the lower surface of the retractable connector.

16. The communications device as in claim 12, wherein the first and second alignment arms of the rocker arm are further configured for stopping rotation of the rocker arm.

17. The communications device as in claim 12, wherein the base of the rocker arm includes a tiebar that connects the first and second alignment arms.

18. The communications device as in claim 12, wherein the base of the rocker arm comprises a first deflection arm located on the first alignment arm and a second deflection arm located on the second alignment arm.

19. The communications device as in claim 12, further comprising a slot formed in the communications device, the retractable connector being slidably retractable into the slot between the first position and the second position.

20. The communications device as in claim 12, wherein the rocker arm further comprises a first protrusion and a second protrusion extending away from respective first and second alignment arms into recesses located in the frame for pivotally mounting the rocker arm on the frame.

21. The communications device as in claim 12, wherein the rocker arm further comprises a pin extending through the first and second alignment arms into the frame for pivotally mounting the rocker arm on the frame.

22. The communications device as in claim 12, further comprising one or more retention surfaces attached to the retractable connector, the retention surfaces being sized and configured to generally prevent the media plug from passing through the lower surface of the retractable connector when the media plug is inserted into the aperture.

23. The communications device as in claim 22, wherein the one or more retention surfaces comprise first and second tabs projecting inwardly into the aperture, the first and second tabs being sized and configured to engage recessed edges in the media plug.

24. A method of attaching a media plug, including a body and a retention clip, to a communications device, including a retractable connector with an upper surface, a lower surface, and an aperture that is sized and configured to receive at least a portion of the media plug, the retractable connector movable between a first position in which the retractable connector is completely or generally disposed within the communications device and a second position in which the retractable connector is generally disposed outside of the communications device, the method comprising:

inserting the media plug into the aperture in the retractable connector;

engaging an end of the media plug with a rocker arm pivotally mounted to the retractable connector, the engagement of the media plug with the rocker arm causing the rocker arm to pivot about an axis;

slidably engaging first and second alignment arms of the rocker arm with first and second sides of the retention clip of the media plug; and engaging first and second locking ears of the first and second alignment arms to the media plug to securely connect the media plug to retractable connector.

* * * * *